US007931096B2

(12) United States Patent
Saha

(10) Patent No.: US 7,931,096 B2
(45) Date of Patent: Apr. 26, 2011

(54) ADAPTIVE USER INTERFACE FOR ROCK DRILLING RIG

(75) Inventor: Heikki Saha, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 223 days.

(21) Appl. No.: 11/991,078

(22) PCT Filed: Aug. 29, 2006

(86) PCT No.: PCT/FI2006/050367

§ 371 (c)(1),
(2), (4) Date: Feb. 27, 2008

(87) PCT Pub. No.: WO2007/026052

PCT Pub. Date: Mar. 8, 2007

(65) Prior Publication Data

US 2009/0250263 A1 Oct. 8, 2009

(30) Foreign Application Priority Data

Aug. 30, 2005 (FI) ..... 20055460

(51) Int. Cl.

| | |
|---|---|
| ***E21B 44/00*** | (2006.01) |
| ***E21B 47/00*** | (2006.01) |
| *G01V 3/00* | (2006.01) |
| *G06F 19/00* | (2006.01) |

(52) U.S. Cl. ..... 175/24; 175/26; 175/40; 340/853.2; 340/853.3; 700/16; 700/180

(58) Field of Classification Search ..... 175/26, 175/24, 40; 700/159, 160, 180; 701/50; 340/853.2, 853.3

See application file for complete search history.

(56) References Cited

U.S. PATENT DOCUMENTS 4,354,233 A * 10/1982 Zhukovsky et al. ..... 702/9

(Continued)

FOREIGN PATENT DOCUMENTS

EP 1 193 366 4/2002

(Continued)

OTHER PUBLICATIONS

G. Viano et al., "Adaptive User Interface for Process Control Based on Multi-Agent Approach", Proceedings of the Working Conference on Advanced Visual Interfaces (AVI 2000); Palermo, Italy, May 23-26, 2000, Proceedings of the Workshop on Advanced Visual Interfaces, 2000, ACM, New York, NY, USA, p. 201-204, Abstract; 1. Introduction; 2. Industrial Needs.

(Continued)

*Primary Examiner* — Ramesh B Patel
(74) *Attorney, Agent, or Firm* — Drinker Biddle & Reath LLP

(57) ABSTRACT

A control apparatus for controlling a multi-phase rock drilling event carried out with a rock drilling rig. In a display of the rock drilling rig or a control unit thereof, a first section is settable for substantially invariable information sources and a second section for information sources to be changed according to the rock drilling situation. Further, a situation-specific rock drilling definition is set in the control apparatus about at least one information source, information relating to which is to be displayed during the rock drilling situation. The working phase of the rock drilling event is checked, and an information source suitable for the phase is selected on the basis of the definition. Information relating to the at least one selected information source is displayed in the display part during execution of the rock drilling phase.

20 Claims, 5 Drawing Sheets

U.S. PATENT DOCUMENTS

| | | | | |
|---|---|---|---|---|
| 4,954,818 | A * | 9/1990 | Nakane et al. | 715/790 |
| 5,237,539 | A * | 8/1993 | Selman | 367/69 |
| 5,648,755 | A * | 7/1997 | Yagihashi | 340/439 |
| 5,842,149 | A | 11/1998 | Harrell et al. | |
| 6,021,377 | A | 2/2000 | Dubinsky et al. | |
| 6,152,246 | A | 11/2000 | King et al. | |
| 6,233,498 | B1 | 5/2001 | King et al. | |
| 6,282,452 | B1 | 8/2001 | DeGuzman et al. | |
| 6,389,360 | B1 | 5/2002 | Alft et al. | |
| 6,629,572 | B2 | 10/2003 | Womer et al. | |
| 6,651,755 | B1 | 11/2003 | Kelpe | |
| 2002/0060093 | A1 * | 5/2002 | Womer et al. | 175/24 |
| 2002/0188425 | A1 * | 12/2002 | Nakagawa et al. | 702/184 |
| 2003/0196824 | A1 | 10/2003 | Gass et al. | |
| 2004/0104046 | A1 | 6/2004 | Kelpe | |
| 2004/0210392 | A1 | 10/2004 | Fleury et al. | |

FOREIGN PATENT DOCUMENTS

| | | |
|---|---|---|
| GB | 1 485 663 | 9/1977 |
| GB | 2 368 600 | 5/2002 |
| JP | 10-306676 | 11/1998 |
| JP | 10-311192 | 11/1998 |
| JP | 2003-013686 | 1/2003 |
| JP | 2003-085594 | 3/2003 |
| KR | 2005-0015038 | 2/2005 |
| RU | 2 067 170 | 9/1996 |
| RU | 2 208 153 | 7/2003 |
| RU | 2 208 154 | 7/2003 |
| WO | 01/98631 | 12/2001 |

OTHER PUBLICATIONS

A Russian Decision on Grant dated Dec. 4, 2009 issued in Russian Application No. 2008112182 (English translation).

* cited by examiner

ADAPTIVE USER INTERFACE FOR ROCK DRILLING RIG

CROSS REFERENCE TO RELATED APPLICATIONS:

This application is the National Stage of International Application No. PCT/FI2006/050367, filed Aug. 29, 2006, and claims benefit of Finnish Application No. 20055460, filed Aug. 30, 2005.

FIELD OF THE INVENTION

The present invention relates to the arrangement of a user interface in a rock drilling rig or in a control unit thereof.

BACKGROUND OF THE INVENTION

A rock drilling event comprises a plurality of steps, such as: boom positioning, moving feed beam against rock, collaring, acceleration ramp, full power drilling, finishing, reverse drifter, and reversing feed beam from rock. These steps are very different and a large amount of different information is presented to the operator by means of several meters. Management of the incoming information flow is not easy for the operator monitoring and controlling the drilling event. A rock drilling rig may comprise a plurality of booms capable of simultaneous drilling, i.e. several drilling events may be in progress. Even if the drilling could be coupled to automatic control, the operator still has to be able to monitor the progress of a plurality of different drilling events, if need be.

Accordingly, the user interfaces of rock drilling rigs comprise a plurality of meters or information sources presented in other manners, which display current information about each drilling event. Instead of conventional, separate meters, graphical user interfaces are also available, wherein measurement information is displayed, for instance in the form of meters displayed on a display. Publication JP10306676 discloses an automatic rock drill having detecting means for detecting the working state of the rock drill and an automatic control device for storing rock drill data, and for controlling the operation of the rock drill on the basis of data received from the detecting means and the drill data. The control device is provided with a display input device for inputting information about the drillable section.

BRIEF DESCRIPTION OF THE INVENTION

The object of the present invention is to provide a new and improved user interface for rock drilling rigs. The object of the invention is achieved with a control apparatus, a rock drilling rig and a computer program product, which are characterized in what is stated in the independent claims. Some preferred embodiments are described in the dependent claims.

An adaptive user interface has now been developed that adapts to the rock drilling situation. A section of at least some view of the display of a rock drilling rig or a control unit thereof can be assigned to information sources that are changed according to the rock drilling situation, and a definition of at least one information source is set rock drilling situation-specifically in a control apparatus, information relating to which source should be displayed in said rock drilling situation. The working phase of the rock drilling event is checked, and an information source suitable for said phase is selected on the basis of said definition. In said section of the display, information relating to said at least one selected information source is displayed during execution of the rock drilling phase. An information source refers generally to an entity providing information for display on the display of a rock drilling rig, a process providing measurement data from some sensor of the rock drilling rig, for example.

In accordance with an aspect of the invention, definition of the working phase and/or selection of the information source may be arranged for instance in response to an indication of a transition in the drilling phase from drilling process management.

Consequently, for different rock drilling situations, rock drilling phase-specific definitions may be stored, on the basis of which information sources suitable for the current situation may be specified for each rock drilling phase. The operator may be provided only with information essential to the drilling phase, which substantially improves usability. In addition, the layout of the display may be tailored to best suit said working state, current essential information, such as a drilling plan modified by the operator, is specified to be displayed in the main window, for example. Accordingly, the user interface adapts to the operating situation.

BRIEF DESCRIPTION OF THE FIGURES

Some embodiments of the invention will be described in more detail in the accompanying drawings, in which FIG. 1 schematically shows a rock drilling rig.

In the figures, some embodiments of the invention are displayed in a simplified manner for the sake of clarity. In the figures, like parts are denoted with the same reference numerals.

DETAILED DESCRIPTION OF SOME EMBODIMENTS OF THE INVENTION

Figure 1:
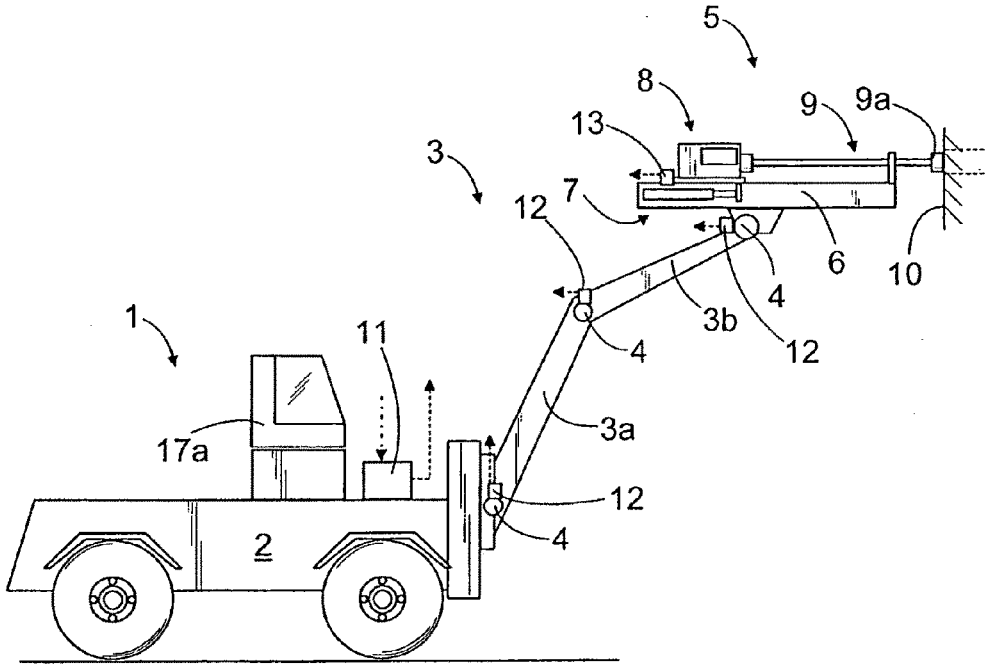

FIG. 1 illustrates a rock drilling rig. It is to be noted that applying the invention is not restricted to any specific rock drilling rig. The invention may also be applied to remote-controlled rock drilling rigs, wherein part of the control means of the rock drilling rig is placed in a separate monitoring room, above ground, for example. This being so, at least part of the characteristics of the invention may thus be implemented in connection with a user interface external to the rock drilling rig.

The rock drilling rig 1 shown in FIG. 1 may comprise a movable carrier 2, in which one or more drilling booms 3 are arranged. The drilling boom 3 may be composed of one or more boom parts 3*a*, 3*b*, which may be connected with each other and with the carrier 2 with joints 4 in a manner allowing the booms 3 to be moved versatilely in different directions. Furthermore, the free end of each drilling boom 3 may comprise a drilling unit 5, which may comprise a feed beam 6, a feeding device 7, a rock drill section 8 and a tool 9, whose outermost end comprises a drill bit 9*a*. The rock drill 8 is movable by means of the feeding device 7 relative to the feed beam 6 in a manner allowing the tool 9 to be fed during drilling towards a rock 10. The rock drill 8 may comprise an impact device for supplying shock pulses to the tool 9, and further a rotating device for rotating the tool 9 around its longitudinal axis. The rock drilling rig 1 comprises a drilling control system 11 for controlling the drilling. The drilling control system 11 may give commands to actuators moving the drilling boom 3 and to other actuators affecting the execution of the drilling event. Furthermore, one or more sensors 12 may be arranged in connection with the joints 4 of the drilling boom 3, and one or more sensors 13 may be arranged in connection with the drilling unit 5. The measurement data obtained from the sensors 12, 13 may be conveyed to the control apparatus 11, which can use the measurement data to determine the position and direction of the drilling unit 5 for controlling purposes. The drilling control system 11 may be adapted to consider the position of the drilling unit 5 as the position of the drill bit 9*a* and the direction of the longitudinal axis of the tool 9. It is to be noted that the drilling control system 11 may be composed of a plurality of subsystems and comprise a plurality of control units, as will be illustrated in the following examples.

Figure 2A:
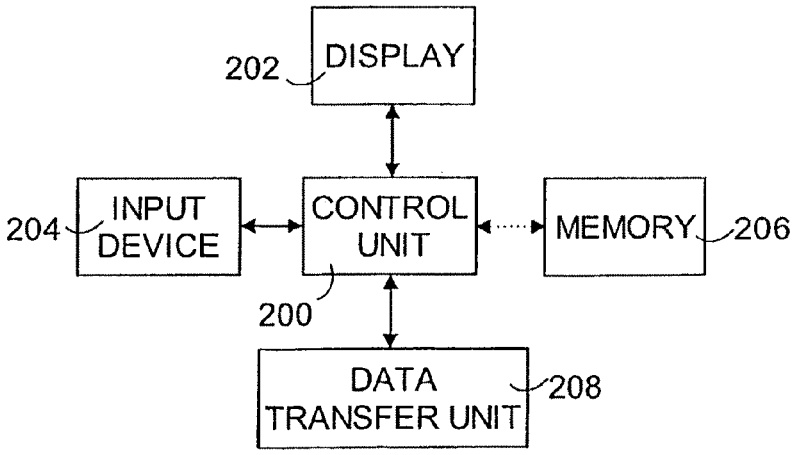
FIGS. 2*a* and 2*b* illustrate some operational units of a control system for a rock drilling rig.

FIG. 2*a* illustrates some operational units of the control apparatus of a rock drilling rig 1, wherein the operational units may be located in the rock drilling rig 1 or in a possible separate monitoring room. A control unit 200 may be part of the general drilling control system 11 of FIG. 1 or in a separate user interface control system and it attends to at least the control of a display 202. Thus, the control unit 200 controls the operations of at least some other operational units of the rock drilling rig 1 and is part of the control system of the rock drilling rig 1. The user interface of the rock drilling rig 1 comprises an input device 204 and a display 202. In addition, the user interface may comprise other parts, such as a loudspeaker. The input device 204 may be any device or a combination of devices, such as a mouse, a spherical controller, a touch screen and/or a joystick that receives inputs from a user. The device of FIG. 2*a* also comprises a data transfer unit 208, which attends to data transfer between the control unit and at least one external data transfer unit. The data transfer unit 208 may attend to the reception of measurement data from sensors 12, 13 and to the transmission of control data to the drilling unit 5, for example. The internal control of the device may utilize some suitable bus technique. The rock drilling rig 1 may also communicate wirelessly, in which case the apparatus 1 comprises a wireless transceiver. The apparatus 1 also comprises memory 206, in which computer program code for controlling the control unit 200 and/or different settings and data employed for controlling the rock drilling rig 1 may be stored, for example.

Computer program codes executed in the processing unit of the rock drilling rig 1 or the external monitoring room may cause the control system to make the control unit 200 implement actions associated particularly with the control of a multi-phase rock drilling event, some embodiments thereof being illustrated below in connection with FIGS. 2*b*, 3*a*, 3*b*, 4, 5*a* and 5*b*. These functions may be implemented for instance as a specific application implementing the selection of the information sources for the display and the display of the information thereof. It is also possible to use a hardware solution or a combination of software and hardware solutions for implementing the inventive functions. Information and computer program code affecting the operation of the rock drilling rig 1 may be stored with a separate memory means and possibly transferred via a network to the memory 206 for implementing the operations of the control unit 200.

FIG. 2*a* shows a control unit 200 that controls the operation of the user interface and controls at least the display 202. The control unit 200 may be arranged to execute also other control functions. It is to be noted that the rock drilling rig 1 may comprise a plurality of control units for different purposes.

Figure 2B:
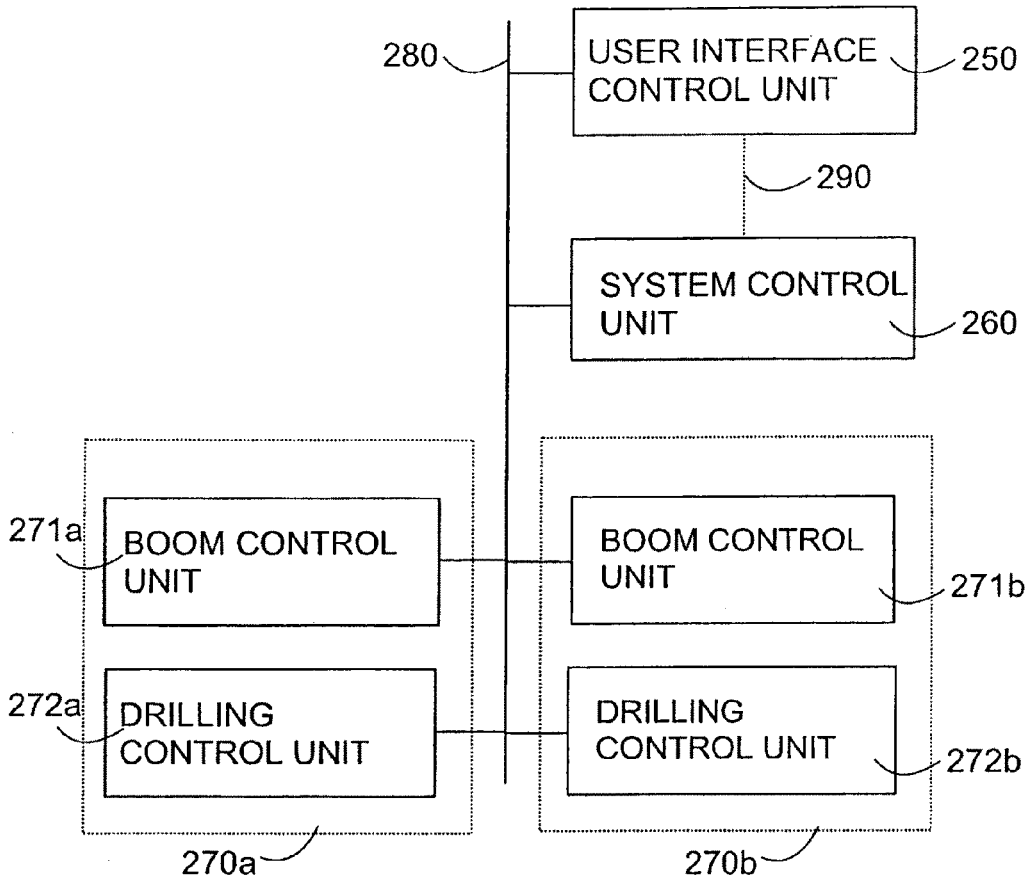

FIG. 2*b* illustrates a control system configuration of the rock drilling rig 1 that may constitute the drilling control system 11 illustrated in FIG. 1. The control system of the rock drilling rig 1 may comprise a plurality of subsystems 270*a*, 270*b* having separate control units. In the control system example of FIG. 2*b*, a separate drilling unit-specific control process or control aggregate 270*a*, 270*b* is arranged for each boom or other type of drilling unit, possibly in such a manner that each boom or other type of drilling unit is controlled and monitored by a separate data processing device. In the system of FIG. 2*b*, the different control units may be implemented with separate data processing devices. Each drilling unit-specific control process 270*a*, 270*b* may comprise a boom control unit 271*a*, 271*b* particularly for controlling the movement of the drilling unit, and a drilling control unit 272*a*, 272*b* for controlling the drilling performed with said drilling unit. These control units 271*a*, 271*b*, 272*a*, 272*b* are further connected to appropriate sensors and/or valves (not shown in FIG. 2*b*). For system management there is a separate system control unit 260, which may attend to the management, transfer and reporting of drilling plans and drilling sequences, for example. A user interface control unit 250 controls the user interface and receives operator inputs from input devices (not shown in FIG. 2*b*). The user interface control unit 250 may be the control unit 200, illustrated in connection with FIG. 2*a* and hereinafter, to which operator input devices 204 and a display 202 are connected.

Information specified by the separate control aggregate and/or process 270*a*, 270*b* is transferred to the user interface control unit 250 that is arranged to display data received from these different units on the display 202. In particular, a working phase state machine for a drilling event executable in said drilling unit may be maintained in the drilling unit-specific process 270*a*, 270*b*, i.e. the working cycle may be specified on the basis of predetermined working cycle definitions and/or commands received from a user. The process 270*a*, 270*b* specifies working phase state data that are transmitted to the user interface control unit 250. By utilizing functions to be described later, the control unit 250 is able to use the received state data and pre-stored definitions to select the information sources, information relating to which should be shown on the display 202.

From each drilling unit-specific process 270*a*, 270*b*, data of several different parts relating to the drilling unit are transferred to the user interface control unit 250, much of which data is to be continuously transferred in order to achieve real-time operation. The part or part of a whole managed by the control unit, from which data are transferred to the user interface control unit, may constitute a dynamically selectable information source. The nature of the information source may be a sub-process that collects and specifies continuous information and is executed in the drilling unit-specific process 270*a*, 270*b*. Some examples include joint position data obtained from the boom control unit 271*a*, 271*b* and different parameters measured from the drilling rig 1. Other parts of the control system or parts supplying necessary information to the user interface of the rock drilling rig 1 may constitute information sources from the point of view of the user interface control unit 250. For example, the system control unit 260 may transmit a view of diagram management and/or system management to the user interface unit 250, which displays the view as one information source on the display 202 by using X-windowing. The user interface control unit 250 is able to arrange the position and size of the X windows, but the information internal to an X window is controlled by the system control unit 260. The system control unit 260 may also transfer other common information about the drilling rig 1 to the user interface control unit 250.

Correspondingly, separate control units may be controlled from one input device 204, in which case the control unit 250 transfers control commands to an appropriate control aggregate 270*a*, 270*b*, for instance to the control device 271*a*, 271*b* of the boom currently controlled by the user, for positioning the boom. In this case, the functions associated with the input device 204 (and the control unit) may vary on the basis of the operating situation and/or the object to be controlled. Information is maintained in the user interface control device 250 about the object being currently controlled and about the functions selectable with the input device 204, or at least about the control units to which an input supplied to the input device 204 is to be relayed. Alternatively, different input devices 204 are employed for managing the different objects and/or other control units are connected to the input device 204.

The control units 250, 260, 271*a*, 271*b*, 272*a*, 272*b* are connected to a data transfer bus 280, for instance to a bus based on the CAN bus technique (Controller Area Network). FIG. 2*b* also illustrates with a broken line 290 a second data transfer interface between the system control unit 260 and the user interface control unit 250, which may be based on Ethernet data transfer, for example.

However, a more detailed description of the control units 260, 271*a*, 271*b*, 272*a*, 272*b* of the rock drilling rig 1 is not required for understanding the invention. The control system, for instance the system control unit 260, may include a subsystem for data collection and reporting and a separate reporting program may be employed for displaying report data to the operator. In the following, the operation of the control system will be illustrated in more detail with reference to FIG. 2*a*. The control system and the control apparatus illustrated above may be located in the rock drilling rig 1 (control apparatus 11). Alternatively, at least part of the control apparatus is located separately from the rock drilling rig 1. For example, the display 202, one or more control units 200 and user interface means for controlling the rock drilling rig 1 may be implemented in a monitoring room located above ground.

In accordance with an embodiment, the control unit 200 is arranged to adaptively select the information sources to be displayed on the display 202 and their layout in accordance with the rock drilling phase. Rock drilling phase-specific definitions, in each of which at least one information source is specified, information relating to which is to be displayed in said rock drilling situation, may be stored in the memory 206 of the rock drilling rig 1. In response to the initiation of a rock drilling event or a transition in the rock drilling phase, the control unit 200 is arranged to check at least one rock drilling phase-specific definition. The control unit 200 is arranged to select the information sources suitable for said phase on the basis of the definition(s), and to display information relating thereto on the display 202.

Figure 3A:
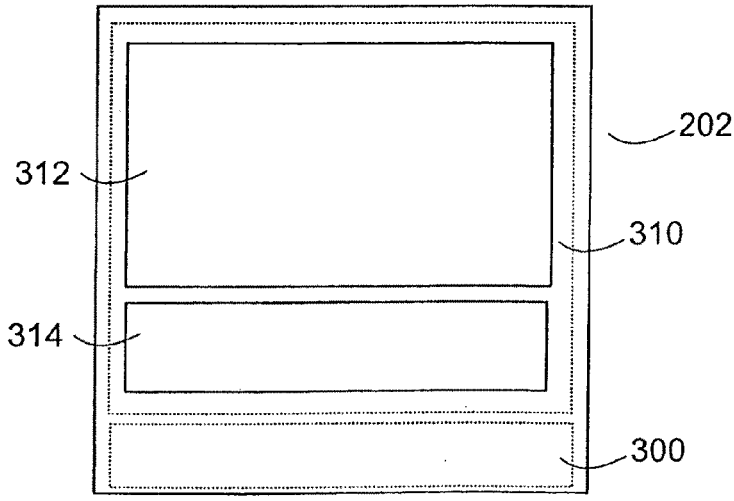
FIGS. 3*a* and 3*b* schematically show some display configurations.

Referring to FIG. 3*a*, in accordance with an embodiment, the layout of the display 202 is divided in such a manner that a first part 300 of the display is set to display substantially the same information sources, whereas a second part 310 is specified in accordance with the rock drilling phase. The control unit 200 is arranged to dynamically specify the information sources, information relating to which is to be displayed in the second part 310 of the display at each particular time, in accordance with the definition linking the rock drilling phase and information sources. The same windows may always be displayed in the first part 300, for instance certain basic information about the drilling rig 1 or a main menu including options selectable by the user. It is to be noted that the information contents displayed in the first part 300 may also be updated in accordance with the drilling situation: For example, the control unit 200 may be arranged to always display a working phase indicator indicative of the current working phase in the first part, in which an indicator, such as an icon, indicative of the current working phase, is updated.

In accordance with an embodiment, the second part 310 that is dynamically updated as regards the information sources is further divided into two or more subsections. The control unit 200 may be arranged to display the information source that is most important to the current working phase in the first subsection 312 that is larger and best visible to the operator. Furthermore, the control unit 200 may be arranged to display one or more information sources supporting the current working phase in the second subsection 314.

In accordance with an embodiment, the control unit 200 may be arranged to not only select information sources but also to working phase-specifically determine the layout and/or form of presentation of the information of the information sources to be displayed. A particularly effective way is to select the information of an information source to be displayed large-sized in the first subsection 312, in which case this information can be easily followed 'with a side glance' as one out of other things to be followed or controlled. More detailed examples will be illustrated hereinafter in connection with FIGS. 5*a* and 5*b*, but for instance, when the control unit 200 detects a transfer to a full power drilling phase, it selects the drilling plan for display in the first subsection 312.

Figure 3B:
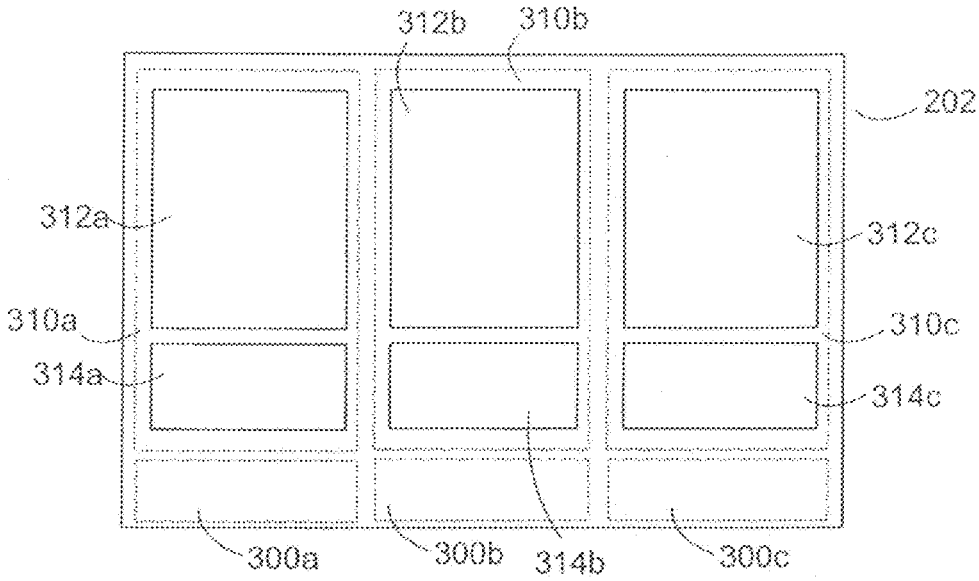

FIG. 3*b* further illustrates the display 202, wherein the control unit 200 is arranged to display separate display areas for each boom, in whose first parts 300*a-c* substantially the same information sources may be displayed, and the configuration of information sources to be displayed in whose second parts 310*a-c* is determined in accordance with the working phase of each boom. As in FIG. 3*a*, at least one second part 310*a-c* can be divided further into subsections 312*a-c* and 314*a-c*. Particularly during control of a plurality of booms, the working phase-specific definition of information sources and display areas according to the present solution brings forth a particular advantage in that information that is essential to the operator can always be selected to be displayed for each boom.

The control unit 200 is arranged to adapt the layout of the display 202 also in accordance with the booms in use, for instance when a boom is not in use, the control unit 200 deletes the display area relating thereto. The space freed may be used for other information; in accordance with an embodiment, the control unit 200 is arranged to re-specify the information sources and/or display definitions of the remaining booms to cover the entire area of the display 200.

It is to be noted that the display configurations shown in FIGS. 3*a* and 3*b* are only one way of arranging the different parts of the display. The placement of parts 300 and 310, and further 312 and 314 can be implemented in a plurality of ways different from these examples. For instance, a different placement, form and/or size of parts 300, 310, 312, 314 may be utilized.

Figure 4:
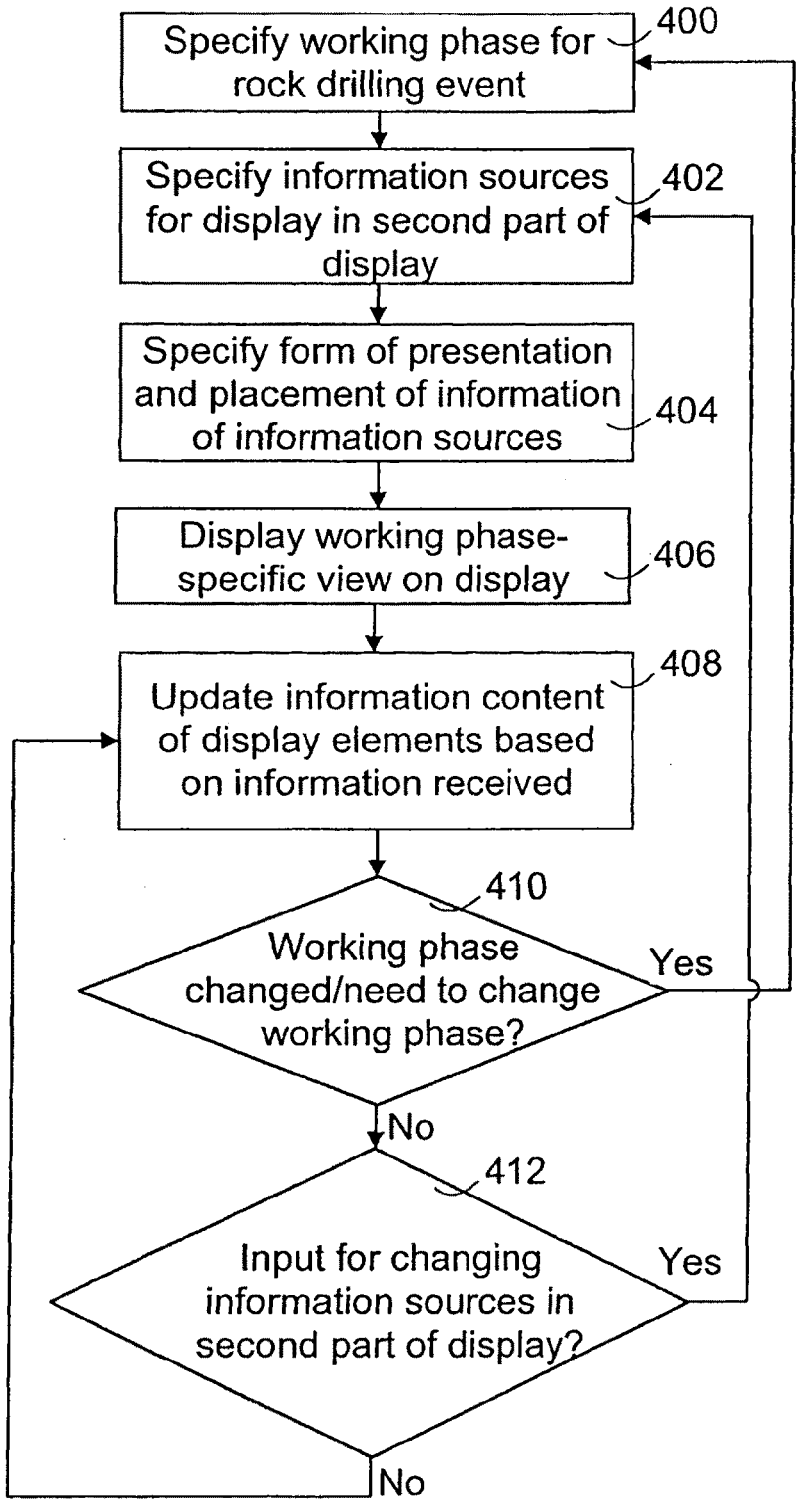
FIG. 4 illustrates a method according to an embodiment.

FIG. 4 illustrates a basic process relating to the second part 310 of the display to be dynamically arranged in accordance with an embodiment, and implementable in the control unit 200. In step 400, the working phase of the rock drilling event is specified, on the basis of which the information sources to be displayed in the second part 310 of the display are selected 402. The definition of the working phase in step 400 may be arranged, depending on the implementation, during a transition in the working phase or on the basis of information indicative of a transition in the working phase. For example, when the control system of FIG. 2*b* is applied, the control unit 250 may specify the working phase on the basis of state data received from the boom-specific control process 270*a*, 270*b*. The selection of the information sources of step 402 may be carried out by checking the rock drilling phase-specific definition associated with the working phase data and retrieved from the memory 206, the definition identifying the identifiers of the information sources to be applied. On the basis of step 402, the control unit 200 arranges data reception from the selected information sources. Referring to FIG. 2*b*, the control unit 250 may transmit control signals from the boom-specific control process 270*a*, 270*b* and/or the system control unit 260 for activating data transfer from the information sources selected.

In step 404, the placement and/or form of representation of the selected information sources is specified. This may be implemented on the basis of settings stored in the memory 206. It is to be noted that also other working phases than the current working phase may be taken into consideration in steps 402 and/or 404.

In step 406, the control unit controls the specified working phase-specific window to be displayed on the display 200. In connection with or after step 402, the control unit 200 is arranged to receive information relating to the selected information sources. The information content of the elements of the display, both in the first part 300 and in the second part 310, is updated 408 on the basis of the information received. Data, which are updated in step 408, are typically received from the other system parts, such as the drilling rig 1. The information content can be updated also on the basis of inputs received from a user.

In step 410, a check is made to see if a change of working phase has occurred or if a change of working phase is required. The control unit 200, 250 may carry out step 406 on the basis of information or a command received from another system part, for example on the basis of state information or other information received from the second control process 270*a*, 270*b* of FIG. 2*b*. This step may be arranged as part of a general screen update or possibly in response to an input (not shown in FIG. 4) received in the control unit 200, for example an input received from the input device 204. If the check 410 indicates that a change of working phase has occurred, then it is necessary to redetermine the second part of the display or at least check if it should be changed, and in the example of FIG. 4, the process continues to step 400. If the change of working phase is already known, step 402 can be directly entered. Alternatively, after the check 410, step 408 is entered for updating the information content displayed on the screen or as in the embodiment of FIG. 4 additional steps are executed.

In step 412, a check is made to see if an input is received for changing the information sources of the second part of the display, more particularly, if a need exists to change information sources, even if the working phase had not changed.

In accordance with an embodiment, in step 412 the control unit 200 is arranged to change information sources and/or the presentation thereof (form of presentation and/or placement) to be displayed in the second part 310 on the basis of information received from the drilling process stating that the working phase does not change.

In accordance with an embodiment, in step 412 the control unit 200 is arranged to change information sources and/or the presentation thereof to be displayed in the second part 310 on the basis of an input received from the operator. The operator may be presented with the option to modify the layout of the display in accordance with the operator's needs. Adaptation on the basis of the user's inputs can be implemented in different manners, examples of which are given in the following: The user may be presented with a menu from which the user may select one out of a plurality of preset presentation configurations. The user may use a movable cursor to select an information source from the second part 310, after which the second part is updated so as to depict the additional information relating to the selected information source and possibly also the manner of presenting the second information source is altered (e.g. made larger).

In accordance with an embodiment, settings relating to the configuration of the display 202 are stored in the memory 206 for later use. For example, operator-specific profiles may be specified for the different operators, wherein settings are stored for the operators, according to which the control unit 200 specifies the window in step 402 and/or 404. These profiles may be stored and retrieved on the basis of an operator-specific user identifier.

In accordance with an embodiment, threshold values are associated with one or more information sources, and a change is initiated in the display 202 at least concerning the information source, should the values be exceeded or subceeded. For example, an alarm limit may be associated with a meter reading, which the control unit 200 monitors. If the control unit 200 detects an exceeding of the alarm limit, it controls the display 200 for instance to cause the colour change or blinking of a display element of the information source. In accordance with an embodiment, exceeding a threshold value may serve as an input resulting in step 402 being entered in the check of step 412.

FIG. 4 is simplified and does not show for instance the start or end of the process, but on the basis of the description, other steps may also be added to this basic process. For example, separate check steps may exists for user inputs achieving or indicating a transition in the working phase and information received from the system control process 270*a*, 270*b*.

A drilling event includes a plurality of steps and a working phase indicator 300 can be used to illustrate the working phase cycle to a user better than previously. For example, at least some of the following phases may be separated from a drilling event: boom positioning in progress, moving feed beam against rock, collaring, acceleration ramp, full power drilling, finishing, reverse drifter, and reversing feed beam from rock. For one or more of the above phases, rock drilling phase-specific definitions may be set and applied. Transfer from one working phase to another is carried out in response to a decision to change working phases by the control process (e.g. process 270*a*, 270*b* of FIG. 2*b*) and/or to an input by the operator. For example, part of the working cycle may be performed automatically, whereas transfer to a given working phase requires an operator input. Information sources may be predetermined for the working phases and/or they may be dynamically determined in connection with step 402. However, it should be noted that the working phases shown in the working phase indicator are not limited to these, but any drilling event working phase cycle can be indicated with appropriate detailing.

Typically, one drilling unit performs one sequential working cycle, but the working cycle may include a phase from which a new working cycle is initiated as a sub-process. The new working cycle may be an auxiliary function, such as a sequence of working phases relating to bar processing, and it is optionally implemented as the original working cycle continues. The new working phase may also have to be initiated because of a state of emergency, for instance when a drill bit is stuck. In accordance with an embodiment, the control unit 200 is arranged to update the second section 310 of the display in response to the initiation of a sub-process for instance by moving to step 402 in response to the initiation of the sub-process.

Definition of the form of presentation of the information of the information sources of step 404 may be implemented in a plurality of manners. For example, rock drilling phase-specific display information elements may be stored in the memory 206, and the control unit 200 retrieves the elements to be displayed on the display 202 in accordance with the current working phase for the information sources selected in step 402. The display information elements descriptive of the information of the information sources may be displayed for instance by using icons, texts, virtual meters, bar patterns, plotters or combinations thereof. The control unit 200 may specify the placement and size of the information of the information sources working phase-specifically, but other definitions for the form of presentation may also be specified in step 404. In step 404, the display information elements descriptive of the information sources may also be specified to be emphasized in different manners, such as by using different colours, contrasts, by blinking an information element, etc.

An information source whose information may be selected to be displayed is an application that generates measurement data, which generates measurement data from the sensor 12, 13 of FIG. 1, for example. Conventionally, measurement data is presented in a set of meters and a virtual meter is a manner of presentation in the present solution. Examples of information to be displayed in a set of meters include: impact, feed, rotation, flushing, penetration speed, and hole depth.

In accordance with an embodiment, the control unit 200 implements a set of meters that attends to the selection (set of meters into view/out of view), placement and shape of the set of meters in the second part 310 of the display. Such a set of meters may be associated with a local application that controls other information to be displayed on the display 202. The set of meters can be invoked for instance in connection with step 404 for replacing the meters. The system associated with control of a user interface may also include one or more remote applications for controlling at least some of the functions illustrated above.

In accordance with an embodiment, the rock drilling rig 1 includes different operating modes, in accordance with which the transition between the different working states is arranged. As was mentioned, the rock drilling rig 1 may have a manual control mode, whereby working states are changed in response to user input, or an automatic control mode, whereby working states may be changed without user input at the end of the previous working phase. Other more detailed operating modes may also be used. In this embodiment, the control unit 200 is arranged to select information elements for the second part 310 of the display in accordance with the operating mode, and the definition of the second part of the display is carried out on the basis of the operating mode and it may complement the functions illustrated above in connection with FIG. 4. The operating mode may also affect the placement and/or form of presentation of the information sources. Furthermore, this embodiment diversifies the adaptiveness of the user interface. The user interface also provides an option to change operating modes.

Figure 5A:
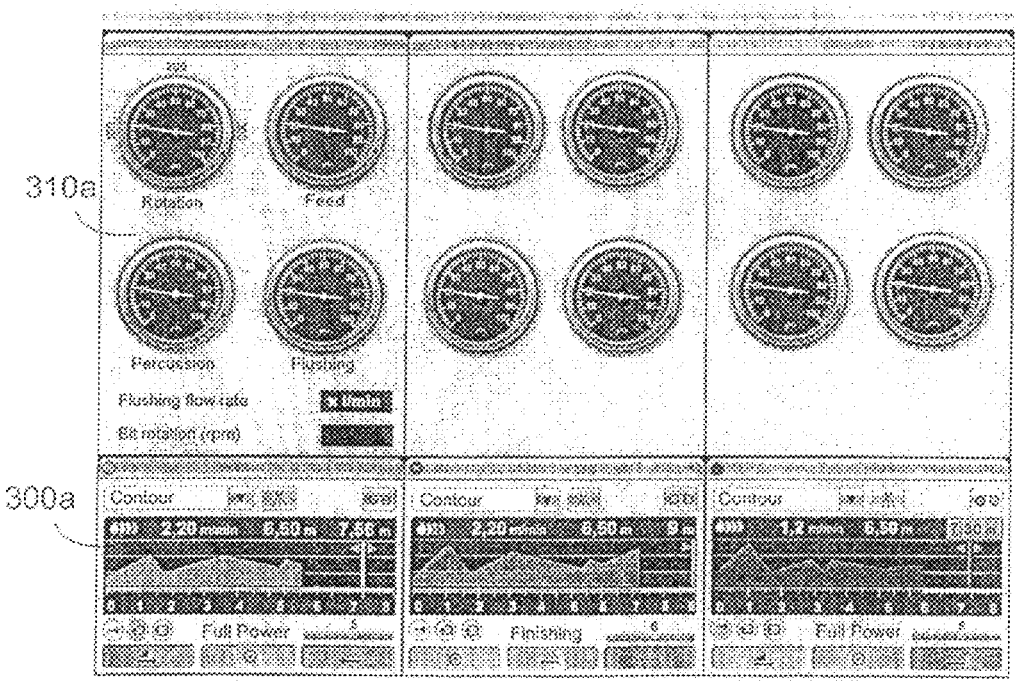
FIGS. 5*a* and 5*b* show some exemplary user interfaces.
Figure 5B:
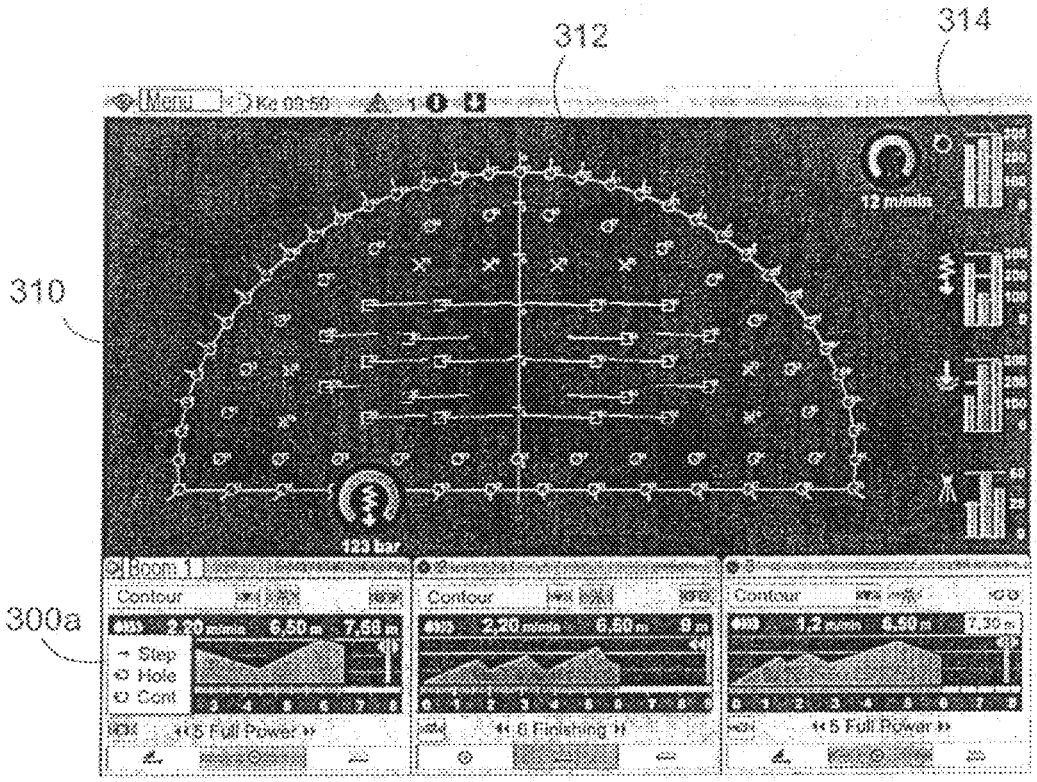

Accompanying FIGS. 5*a* and 5*b* illustrate examples of user interfaces for implementing virtual meters that change in accordance with the drilling situation. FIG. 5*a* illustrates a state of a user interface, wherein the control unit 200 has controlled boom-specific display sections for three different booms, wherein the lower part 310*a* of the display section, referring to a first boom, is reserved substantially for the same information sources, among other things, the lower edge for a working state indicator indicating the drilling state (an icon for the previous, current and next working phase).

As is illustrated in FIG. 5*b*, the control unit 200 may be arranged to display not only the separate boom-specific parts but also a common information window, in this example, a drilling plan in the updateable second part 310 of the display. In FIG. 5*b*, division into subsections is also applied; the drilling plan is located in a first subsection 312, and measurement information in bar form in a second subsection 314. The information of the second subsection 312 may be for instance from the same information sources as in FIG. 5*a*, wherein the information was displayed in meter form. Indeed, the control unit 200 may be arranged to change the manner of presentation of the information on the basis of the working state and/or user inputs. For example, a subset of the meter series (impact, feed, rotation, flushing, penetration speed, hole depth) of the boom of each drilling rig may be implemented as a separate window that is changed in accordance with the drilling situation. The position and size of the meters on the display depend for example on the operating situation of said user interface and/or apparatus.

In the following, a use example is presented by means of FIG. 5*b*. An operator drills by using automatic drilling, the control unit 200 being arranged to display the information sources illustrated in display 5*a*, i.e. 'virtual meters' in different forms, clearly visible on the right side of the drilling plan as four bar-form graphs to allow the operator to easily monitor the operation of the apparatus. The operator modifies the drilling plan at the same time as at least some of the booms are drilling. The virtual meters of the drilling booms are visible, but smaller, in order to leave sufficient display area for editing the drilling plan. The same principle may be applied when the operator positions a boom by manual run, for example. On the basis of the operator's inputs, the position of the virtual meters may be moved to other positions on the display 202 such that the operator's focus area can be released.

Other use case examples are presented in the following:

- Diagram-based drilling is in progress, whereby the control unit 200 controls the drilling plan to be displayed as large as possible with meters placed outside the diagram.
- Automatic drilling and the editing of a drilling plan (not in active use) are in progress: The control unit 200 controls the diagram to be displayed as in diagram-based drilling, as well as the meters, since monitoring the drilling situation is important.
- 'Override' of automatic drilling with a manual input device (204), such as a joystick or manual start (of drilling): The control unit 200 controls the diagram to be displayed large during manual control.
- Use of auxiliary system functions (e.g. transfer of files or reporting) during automatic drilling: The control unit 200 controls small meters to be displayed either in an area not containing other information or their backgrounds to be displayed transparent, whereby the displays associated with the auxiliary functions are visible from below.
- The operator particularly wants to monitor the drilling instead of the whole: The control unit 200 controls large meters to the main display (312) on top of any display (typically a drilling plan). The control unit 200 may control activation and restoration into small meters in response to operator input.

However, it is to be noted that the characteristics illustrated above may be applied to many different types of situations and the control system may be optimized to provide an adaptive user interface by attempting to provide the operator with only relevant information in each particular operating situation.

In some cases, the characteristics disclosed in the present application may be used as such, irrespective of the other characteristics. On the other hand, the characteristics disclosed in the present application may be combined for generating different combinations, if need be. The drawings and the related description are only intended to illustrate the idea of the invention. The details of the invention may vary within the scope of the claims.

The invention claimed is:

1. A control apparatus for controlling a multi-phase rock drilling event carried out with a rock drilling rig, the control apparatus comprising a display, an input device for receiving user inputs, and a control unit for controlling information to be displayed on the display, wherein at least part of the display is reserved for information sources to be changed according to a rock drilling situation during a rock drilling event, and a rock drilling phase-specific definition is set in the control apparatus for at least one information source, information relating to at least one information source is to be displayed during said rock drilling phase, the control unit is configured to check the rock drilling phase-specific definition in response to an initiation of a rock drilling event or a transition in the rock drilling phase, the control unit is configured to select at least one information source suitable for said phase on the basis of said checked definition, and the control unit is configured, automatically, on the basis of a change of the working phase, to replace or rearrange at least display information relating to the at least one information source of the previous rock drilling phase with display information relating to the at least one selected information source during execution of the current rock drilling phase in said at least part of the display.

2. A control apparatus as claimed in claim 1, wherein a first section of the display is settable for substantially invariable information sources, and a second section for information sources that vary according to the rock drilling situation.

3. A control apparatus as claimed in claim 1, wherein the control apparatus is configured to activate data collection from the at least one selected information source, and to arrange data transfer from the information source to the control unit, and the control unit is configured to receive data from the information source selected, and to update said display section so as to display the data received.

4. A control apparatus as claimed in claim 1, wherein a first subsection and a second subsection are separable from said display section, and the control unit is to specify, for each information source displayed in said display section, if information of the information source is to be displayed in the first subsection or in the second subsection, and the control unit is configured to display information of the information sources in the subsections on the basis of said definition step.

5. A control apparatus as claimed in claim 1, wherein different selectable operating modes are set in the control apparatus, according to which modes a transition between different working states is specified, and the control unit is configured to select the information source in accordance with the operating mode in use.

6. A control apparatus as claimed in claim 1, wherein the control unit is configured to display a specific updateable area for each drilling unit on the display, and the control unit is configured to select the information sources to be displayed in each drilling unit-specific area on the basis of the current rock drilling phase, and the control unit is configured to display the drilling unit-specific information sources selected in corresponding drilling unit-specific areas.

7. A control apparatus as claimed in claim 1, wherein the control unit is configured to specify the placement and/or form of presentation of information of the at least one selected information source on the basis of predetermined settings, and the control unit is configured to display the information relating to the at least one selected information source in the position and form of presentation defined, in said display section during execution of the rock drilling phase.

8. A control apparatus as claimed in claim 1, wherein the rock drilling phase-specific definitions are stored in a memory in the control apparatus and they match working phase identifiers with information source identifiers, the control unit is configured to select at least one information source on the basis of the rock drilling phase-specific definition and state information or identifier indicating the current phase.

9. A control apparatus as claimed in claim 1, the control apparatus further comprising at least one drilling management unit configured to maintain a state machine about a rock drilling event, whereby the drilling management unit is configured to transmit the state information to said display-controlling control unit for indicating at least the current working phase, and the control unit is configured to specify a need to start a rock drilling event or a transition to the next rock drilling phase, and to select at least one information source on the basis of the state information received from the drilling management unit.

10. A control apparatus as claimed in claim 1, wherein the control unit is arranged to define the layout of the presentation of the information of the at least one information source rock working-phase specifically.

11. A rock drilling rig comprising a drilling unit for executing a multiphase rock drilling event, a display, an input device for receiving user inputs, and a control unit for controlling information to be displayed on the display, wherein at least part of the display is reserved for information sources to be changed according to a rock drilling situation during a rock drilling event, and a rock drilling phase-specific definition is set in the control apparatus for at least one information source, information relating to at least one information source is to be displayed during said rock drilling phase, the control unit is configured to check the rock drilling phase-specific definition in response to an initiation of a rock drilling event or a transition in the rock drilling phase, the control unit is configured to select at least one information source suitable for said phase on the basis of said checked definition, and the control unit is configured, automatically, on the basis of a change of the working phase, to replace or rearrange at least display information relating to the at least one information source of the previous rock drilling phase with display information relating to the at least one selected information source during execution of the current rock drilling phase in said at least part of the display.

12. A rock drilling rig as claimed in claim 11, wherein a first section of the display is settable for substantially invariable information sources, and a second section for information sources that vary according to the rock drilling situation.

13. A rock drilling rig as claimed in claim 11, wherein the control apparatus is configured to activate data collection from the at least one selected information source, and to arrange data transfer from the information source to the control unit, and the control unit is configured to receive data from the information source selected, and to update said display section so as to display the data received.

14. A rock drilling rig as claimed in claim 11, wherein a first subsection and a second subsection are separable from said display section, and the control unit is configured to specify, for each information source displayed in said display section, if information of the information source is to be displayed in the first subsection or in the second subsection, and the control unit is configured to display information of the information sources in the subsections on the basis of said definition step.

15. A rock drilling rig as claimed in claim 11, wherein different selectable operating modes are set in the control apparatus, according to which modes a transition between different working states is specified, and the control unit is configured to select the information source in accordance with the operating mode in use.

16. A rock drilling rig as claimed in claim 11, wherein the control unit is configured to display a specific updateable area for each drilling unit on the display, and the control unit is configured to select the information sources to be displayed in each drilling unit-specific area on the basis of the current rock drilling phase, and the control unit is configured to display the drilling unit-specific information sources selected in corresponding drilling unit-specific areas.

17. A rock drilling rig as claimed in claim 11, wherein the control unit is configured to specify the placement and/or form of presentation of information of the at least one selected information source on the basis of predetermined settings, and the control unit is configured to display the information relating to the at least one selected information source in the position and form of presentation defined, in said display section during execution of the rock drilling phase.

18. A memory medium embodying a computer program product for controlling at least one data processing device of a control apparatus of a rock drilling rig, wherein the computer program product comprises computer program code that controls, when executed in a processor of the data processing device, a control system to:

check a rock drilling phase-specific definition in response to an initiation of a rock drilling event or a transition in a rock drilling phase during a rock drilling event, the rock drilling phase-specific definition specifying at least one information source, information relating to which should be displayed in said rock drilling phase, select at least one information source suitable for said phase on the basis of said checked definition, and display information, automatically, on the basis of a change of the working phase, relating to the at least one selected information source in a section of a display of the control system in the location where information relating to at least one previous information source relating to a previous rock drilling phase was displayed, the section being set for information sources to be changed according to the rock drilling situation, during execution of the rock drilling phase.

19. A memory medium as claimed in claim 18, wherein the computer program product comprises computer program code that controls the control system to activate data collection from the at least one selected information source and to arrange data transfer from the information source, and to receive data from the information source selected and to update said display section so as to display the data received.

20. A memory medium as claimed in claim 18, wherein the computer program product comprises computer program code that controls the control system to specify the placement and/or form of presentation of information of the at least one selected information source on the basis of predetermined settings, and to display information relating to the at least one selected information source in the position and form of presentation defined, in said display section during execution of the rock drilling phase.

* * * * *